US012590517B2

(12) United States Patent
Lott et al.

(10) Patent No.: US 12,590,517 B2
(45) Date of Patent: Mar. 31, 2026

(54) SYSTEM AND METHOD FOR INSTALLING TOOL FOR USE WITH ARTIFICIAL LIFT MANDREL

(71) Applicant: TRC Services, Inc., The Woodlands, TX (US)

(72) Inventors: Dustin Wayne Lott, Katy, TX (US); Gustavo Pertuz, Katy, TX (US)

(73) Assignee: TRC SERVICES, INC., The Woodlands, TX (US)

( * ) Notice: Subject to any disclaimer, the term of this patent is extended or adjusted under 35 U.S.C. 154(b) by 0 days.

(21) Appl. No.: 18/909,832

(22) Filed: Oct. 8, 2024

(65) Prior Publication Data

US 2025/0122783 A1 Apr. 17, 2025

Related U.S. Application Data

(60) Provisional application No. 63/635,853, filed on Apr. 18, 2024, provisional application No. 63/543,915, filed on Oct. 12, 2023.

(51) Int. Cl.
*E21B 43/12* (2006.01)

(52) U.S. Cl.
CPC ..... *E21B 43/123* (2013.01); *E21B 43/124* (2013.01)

(58) Field of Classification Search
CPC .... E21B 43/122; E21B 43/123; E21B 43/124; E21B 43/129
See application file for complete search history.

(56) References Cited

U.S. PATENT DOCUMENTS

| | | | | |
|---|---|---|---|---|
| 4,413,958 | A | 11/1983 | Webb | |
| 4,441,861 | A * | 4/1984 | Canalizo | F04F 5/54 417/54 |
| 4,603,735 | A | 8/1986 | Black | |
| 5,562,161 | A | 10/1996 | Hisaw et al. | |
| 5,806,599 | A | 9/1998 | Hisaw et al. | |
| 6,102,828 | A | 8/2000 | MacKenzie | |
| 6,354,371 | B1 | 3/2002 | O'Blanc | |
| 6,758,277 | B2 | 7/2004 | Vinegar et al. | |
| 7,063,161 | B2 | 6/2006 | Butler et al. | |
| 7,066,268 | B2 | 6/2006 | Khomynets | |

(Continued)

FOREIGN PATENT DOCUMENTS

| | | | |
|---|---|---|---|
| MX | 2019009556 | A | 2/2021 |
| WO | 03036011 | A2 | 5/2003 |

*Primary Examiner* — Kristyn A Hall
(74) *Attorney, Agent, or Firm* — Cabello Hall Zinda, PLLC

(57) ABSTRACT

A system used with a gas lift valve on a tubing string in a borehole includes a mandrel assembly and a tool assembly. The mandrel assembly holds the gas lift valve disposed in communication between a through-bore and a borehole port. The mandrel assembly couples to the tubing string and defines a lock profile, an uphole seal bore profile, and a downhole seal bore profile. The tool assembly is configured to retrievably deploy in the tubing string. The tool assembly has a lock, an uphole seal, an auxiliary tool, and a downhole seal. The lock is releasably engageable with the lock profile, and the uphole and downhole seals are sealably engageable respectively with the seal bore profiles. The auxiliary tool, which can be a jet pump or a venturi device, has an annulus port that communicates with an annular area of the through-bore sealed by the uphole and downhole seals.

21 Claims, 5 Drawing Sheets

(56) References Cited

U.S. PATENT DOCUMENTS

| | | | | |
|---|---|---|---|---|
| 7,909,089 | B2 | 3/2011 | Jackson | |
| 9,181,786 | B1 | 11/2015 | Portman | |
| 9,638,215 | B2 | 5/2017 | Burgess | |
| 10,975,675 | B2 | 4/2021 | Gonzalez Castillo | |
| 2004/0118774 | A1 | 6/2004 | Davidian et al. | |
| 2005/0155767 | A1 | 7/2005 | Batho et al. | |
| 2007/0114038 | A1 | 5/2007 | Daniels et al. | |
| 2010/0326661 | A1 | 12/2010 | Khomynets | |
| 2018/0100382 | A1 | 4/2018 | Agarwal et al. | |
| 2021/0071507 | A1* | 3/2021 | Kennedy | E21B 43/123 |
| 2022/0268138 | A1* | 8/2022 | Alves Sao Mateus | E21B 33/124 |

* cited by examiner

SYSTEM AND METHOD FOR INSTALLING TOOL FOR USE WITH ARTIFICIAL LIFT MANDREL

CROSS-REFERENCE TO RELATED APPLICATIONS

This application claims the benefit of U.S. Provisional Appl. No. 63/543,915 filed Oct. 12, 2023 and U.S. Provisional Appl. No. 63/635,853 filed Apr. 18, 2024, which are incorporated herein by reference in their entireties.

BACKGROUND OF THE DISCLOSURE

To obtain hydrocarbon fluids from an earth formation, a borehole is drilled into an area of interest within a formation. The borehole may then be "completed" by inserting casing in the borehole and setting the casing using cement. Alternatively, the borehole may remain uncased as an "open hole"), or it may be only partially cased. Regardless of the form of the borehole, production tubing is run into the borehole to convey production fluid (e.g., hydrocarbon fluid, which may also include water) to the surface.

Often, the pressure within the borehole is insufficient to cause the production fluid to naturally rise through the production tubing to the surface. In these cases, an artificial lift system can be used to carry the production fluid to the surface. One type of artificial lift system is a gas lift system, of which there are two primary types of systems: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid from flowing in the opposite direction from the production tubing into the annulus.

A typical wireline-retrievable gas lift system 10 is shown in FIG. 1. Operators inject compressed gas G into the borehole annulus 22 between a tubing string 20 and the casing 24 within a cased borehole 26. A valve system 12 supplies the injection gas G from the surface and allows produced fluid to exit the gas lift system 10.

Mandrels 21 are spaced along the tubing string 20 to hold gas lift valves 28. In the present example, the mandrels 21 are side pocket mandrels spaced along the tubing string 20 to hold wireline-retrievable gas lift valves 28 within side pockets 23. Other arrangements are possible for mandrels and gas lift valves. As noted previously, the gas lift valves 28 are one-way valves that allow gas flow from the borehole annulus 22 into the tubing string 20 and prevent reverse flow from the tubing string 20 into the borehole annulus 22.

In some cases, such as shown here, a production packer 14 can be located on the tubing string 20 to force the flow of production fluid P from a formation up through the tubing string 20 instead of up through the borehole annulus 22. Additionally, the production packer 14 forces the gas flow from the borehole annulus 22 into the tubing string 20 through the gas lift valves 28. Other arrangements are possible that do not include a production packer.

In operation, the production fluid P flows from the formation into the borehole 26 through casing perforations P and then flows into the tubing string 20. When it is desired to lift the production fluid P, compressed gas G is introduced into the borehole annulus 22, and the gas G enters from the borehole annulus 22 through borehole ports 27 in the mandrel's side pockets 23. Disposed inside the side pockets 23, the gas lift valves 28 control the flow of injected gas I into the tubing string 20. As the injected gas I rises to the surface, it helps to lift the production fluid P up the tubing string 20 to the surface.

Gas lift valves 28 have been used for many years to assist the production of fluid to the surface. Once run downhole, the gas lift valves 28 control the injection of compressed natural gas into the production stream, aiding in the recovery of hydrocarbons. The gas lift valve 28 uses a pressure-sensitive valve mechanism having a metal bellows and a piston to convert pressure into movement. Injected gas acts on the bellows to open the pressure-sensitive valve mechanism, and the gas passes through the gas lift valve 28 into the tubing string. As differential pressure is reduced on the bellows, the valve mechanism in the gas lift valve 28 can close.

Over time, the production from the well declines, and the gas lift becomes less efficient. In such instances, it can be beneficial to install additional components in the tubing string to supplement the gas lift and increase production. For example, a device can be installed in the tubing string to supplement the operation of a gas lift valve. For example, U.S. Pat. No. 5,806,599 discloses a venturi device that is set in the tubing string using expandable slips. The venturi device has seals so the venturi device can communicate with a gas lift valve in a side pocket mandrel. In another example, U.S. Pat. No. 5,806,599 discloses a production accelerator device that installs in a sliding sleeve so the production accelerator can accelerate production.

In another example, US Patent Publication 2018/0100382 discloses an arrangement in which a jet pump installs in a tubing string and has seals so the jet pump can communicate with a gas lift valve in a side pocket mandrel.

The subject matter of the present disclosure is directed to overcoming, or at least reducing the effects of, one or more of the problems set forth above.

SUMMARY OF THE DISCLOSURE

An artificial lift system disclosed herein is for use on a tubing string in a borehole. The artificial lift system comprises a mandrel assembly and a tool assembly. The mandrel assembly has an uphole end and a downhole end. The uphole end of the mandrel assembly is configured to couple to the tubing string, and the downhole end of the mandrel assembly is configured to couple to the tubing string. The mandrel assembly defines a throughbore and defines a borehole port. The throughbore extends between the uphole end and the downhole end, and the borehole port communicates outside the mandrel assembly. The mandrel assembly is configured to hold a gas lift valve. The gas lift valve is associated with the borehole port and is configured to control fluid communication between the throughbore and the borehole. The throughbore defines a lock profile, an uphole seal bore profile toward the uphole end, and a downhole seal bore profile toward the downhole end.

The tool assembly is configured to retrievably deploy in the tubing string. The tool assembly has a lock, an uphole seal, an auxiliary tool, and a downhole seal. The lock is releasably engageable with the lock profile. The uphole seal is sealably engageable with the uphole seal bore profile, and the downhole seal is sealably engageable with the downhole seal bore profile. The auxiliary tool has at least one annulus port configured to communicate with an annular area of the throughbore sealed by the uphole seal and the downhole seal.

In one configuration, the mandrel assembly can include a mandrel defining a side pocket communicating with the throughbore of the mandrel assembly. The side pocket can define the borehole port and can be configured to hold the gas lift valve therein so the gas lift valve can control fluid communication between the borehole port and the annular area of the throughbore.

In another configuration, the mandrel assembly can include a mandrel defining an external pocket communicating with the borehole port of the mandrel assembly. The borehole port can communicate with the annular area of the throughbore, and the external pocket can hold the gas lift valve therein so the gas lift valve can control fluid communication between the borehole and the borehole port.

In yet another configuration, the mandrel assembly can include a mandrel, an uphole component, and a downhole component. The mandrel can have a first end and a second end and can define an intermediate bore of the throughbore of the mandrel assembly. The mandrel can also define the borehole port and can hold the gas lift valve. The uphole component can be disposed at the uphole end of the mandrel assembly and can be configured to couple between the tubing string and the first end of the mandrel. The uphole component can have an uphole bore of the throughbore in which the lock profile and the uphole seal bore profile are defined. Finally, the downhole component can be disposed at the downhole end of the mandrel assembly and can be configured to couple between the tubing string and the second end of the mandrel. The downhole component can have a downhole bore of the throughbore in which the downhole seal bore profile is defined.

The auxiliary tool can comprise at least one of a jet pump, a supersonic tool, and a venturi device.

In one arrangement, the auxiliary tool can include an intake, a nozzle, a mixing tube, and a diffuser. The intake can be in fluid communication with the tubing string downhole of the downhole seal, and the intake can define a throat. The nozzle can be disposed in the intake, and the nozzle can have an inlet and an outlet. The inlet can be disposed in fluid communication with the at least one annulus port of the auxiliary tool, and the outlet can be disposed in fluid communication with the throat of the intake. The mixing tube can be disposed in fluid communication with the throat of the intake, and the diffuser can be disposed in fluid communication with the mixing tube. The diffuser can have an output disposed in fluid communication with the tubing string uphole of the uphole seal.

The mandrel assembly can include a landing nipple having the lock profile, and the tool assembly can include a lock mandrel having the lock. The lock can include at least one of: a dog, a key, a collet, and a ring being selectively movable between locked and unlocked conditions. Each of the uphole seal and the downhole seal can include at least one of: an elastomeric ring, a chevron seal, and a cup seal disposed about the mandrel assembly.

An assembly disclosed herein is for use with a gas lift valve on a tubing string in a borehole. The assembly comprises a body having an uphole end and a downhole end. The body defines a throughbore and defines borehole port. The throughbore extends between the uphole end and the downhole end. The body is configured to hold the gas lift valve associated with the borehole port such that the gas lift valve is configured to control fluid communication between the throughbore and the borehole. The uphole end of the body is configured to couple to the tubing string, and the downhole end of the body is configured to couple to the tubing string. The throughbore defines a lock profile, an uphole seal bore profile toward the uphole end, and a downhole seal bore profile toward the downhole end.

In one configuration, the body includes a mandrel, at least one uphole component, and at least one downhole component. The mandrel has a first end and a second end, and the mandrel defines an intermediate bore of the throughbore and defining borehole port. The intermediate bore extends between the first end and the second end, and the mandrel is configured to hold the gas lift valve. The at least one uphole component is configured to couple between the first end of the mandrel and the tubing string. The at least one uphole component defines an uphole bore of the throughbore communicating with the intermediate bore of the mandrel, and the uphole bore defines the lock profile and defining the uphole seal bore profile. The at least one downhole component is configured to couple between the second end of the mandrel and the tubing string. The at least one downhole component defines a downhole bore of the throughbore communicating with the intermediate bore of the mandrel, and the downhole bore defines the downhole seal bore profile.

A method disclosed herein is for performing gas lift on a tubing string in a borehole. The method comprises: deploying a mandrel assembly on the tubing string in the borehole, the mandrel assembly being configured to hold the gas lift valve; and removably installing a tool assembly in a throughbore of the mandrel assembly adjacent the gas lift valve. To removably install the tool assembly, the method comprises sealing at least one annulus port of the tool assembly with the gas lift valve; and releasably engaging a lock on the tool assembly with a lock profile defined inside the throughbore of the mandrel assembly.

To seal the at least one annulus port of the tool assembly with the gas lift valve, the method can comprise: sealably engaging a downhole seal on the tool assembly with a downhole seal bore profile defined inside the throughbore toward a downhole end of the mandrel assembly; and sealably engaging an uphole seal on the tool assembly with an uphole seal bore profile defined inside the throughbore toward an uphole end of the mandrel assembly.

The method can further comprises: injecting gas into an annulus between the tubing string and the borehole; and controlling communication of the injected gas through the gas lift valve to the at least one annulus port of the tool assembly.

The method can further comprise: intaking production fluid into an intake of the tool assembly from the tubing string downhole of the downhole seal; inletting the injected gas into the at least one annulus port of the tool assembly; jetting the injected gas at the at least one annulus port from an outlet of a nozzle to a throat of the intake; mixing the jetted gas and the production fluid in a mixing tube disposed in fluid communication with the throat of the intake; and diffusing the mixed gas and the production fluid from the mixing tube in a diffuser to an output in fluid communication with the tubing string uphole of the uphole seal.

To removably install the tool assembly in the throughbore of the mandrel assembly adjacent the gas lift valve, the method can comprise running the tool assembly on at least one of a slickline and a wireline in the tubing and operating the lock on the tool assembly.

To deploy the mandrel assembly on the tubing string in the borehole, the method can comprise: coupling an uphole end and a downhole end of a mandrel body to the tubing, the mandrel body defining the throughbore and defining a borehole port, the throughbore extending between the uphole end and the downhole end, the mandrel body being configured to hold the gas lift valve disposed in communication with the borehole port, the throughbore defining the lock profile, the uphole seal bore profile toward the uphole end, the downhole seal bore profile toward the downhole end.

To deploy the mandrel assembly on the tubing string in the borehole, the method can comprise: coupling a first component between a first end of a mandrel and the tubing string; coupling a second component between a second end of the mandrel and the tubing string, wherein the mandrel defines an intermediate bore of the throughbore of the mandrel assembly, the mandrel defining a borehole port, the mandrel being configured to hold the gas lift valve disposed in communication with the borehole port; wherein the first component defines an uphole bore of the throughbore in which the lock profile and the uphole seal bore profile are defined; and wherein the second component defines a downhole bore of the throughbore in which the downhole seal bore profile is defined.

To deploy the mandrel assembly on the tubing string in the borehole, the method can comprise deploying a plurality of the mandrel assembly on the tubing string; and wherein removably installing the tool assembly in the throughbore of the mandrel assembly comprises selectively installing the tool assembly in any one of the plurality of the mandrel assembly.

The method can comprise: initially performing a gas lift operation using the gas lift valve in the mandrel assembly without having the tool assembly installed; identifying a decline of produced fluid from the gas lift operation; and in response to the decline, removably installing the tool assembly, and performing a modified gas lift operation using the gas lift valve in the mandrel assembly having the tool assembly installed.

The foregoing summary is not intended to summarize each potential embodiment or every aspect of the present disclosure.

DETAILED DESCRIPTION OF THE DISCLOSURE

Figure 1:
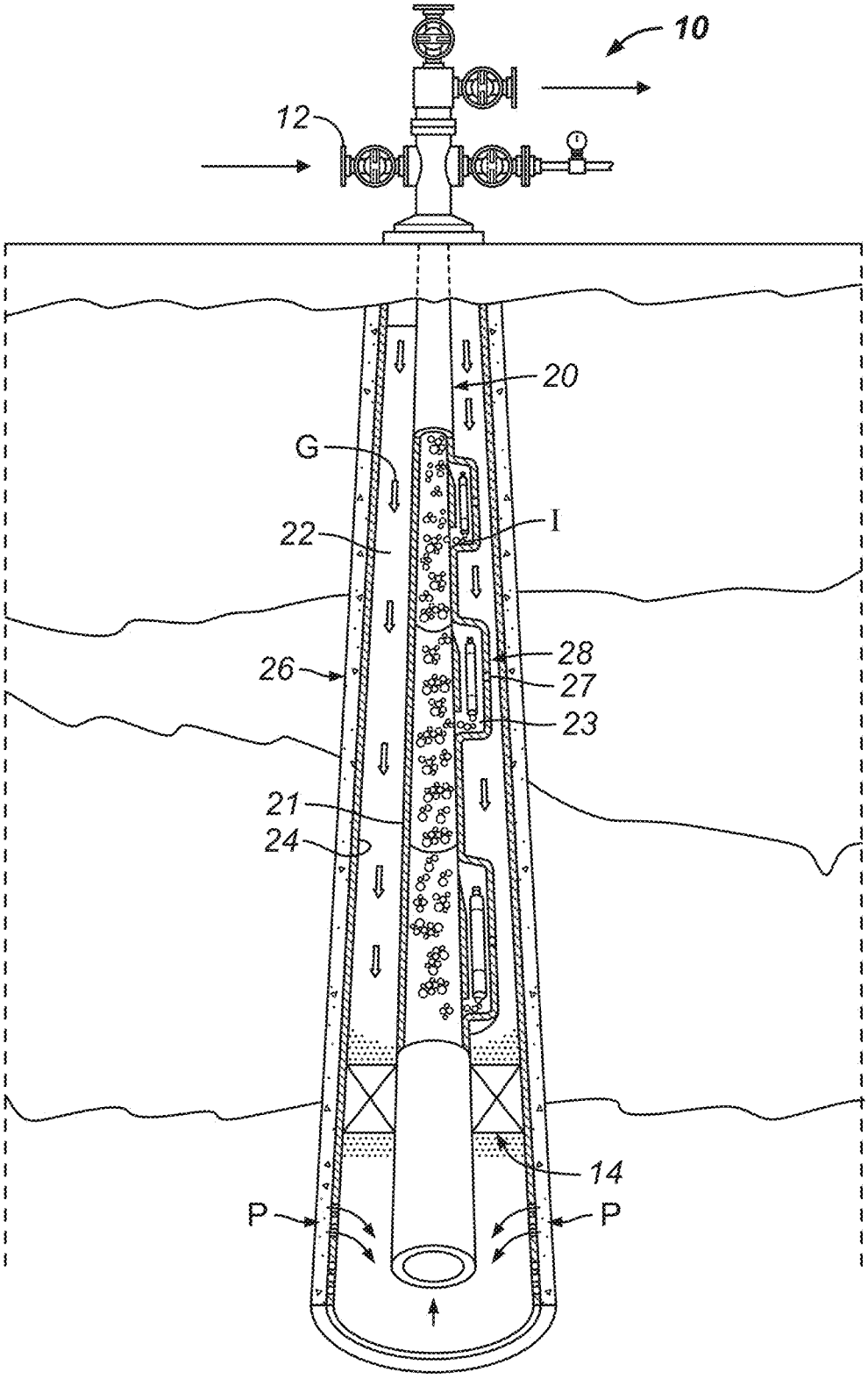
FIG. 1 (Prior Art)
FIG. 1 illustrates a conventional gas lift system.
Figure 2A:
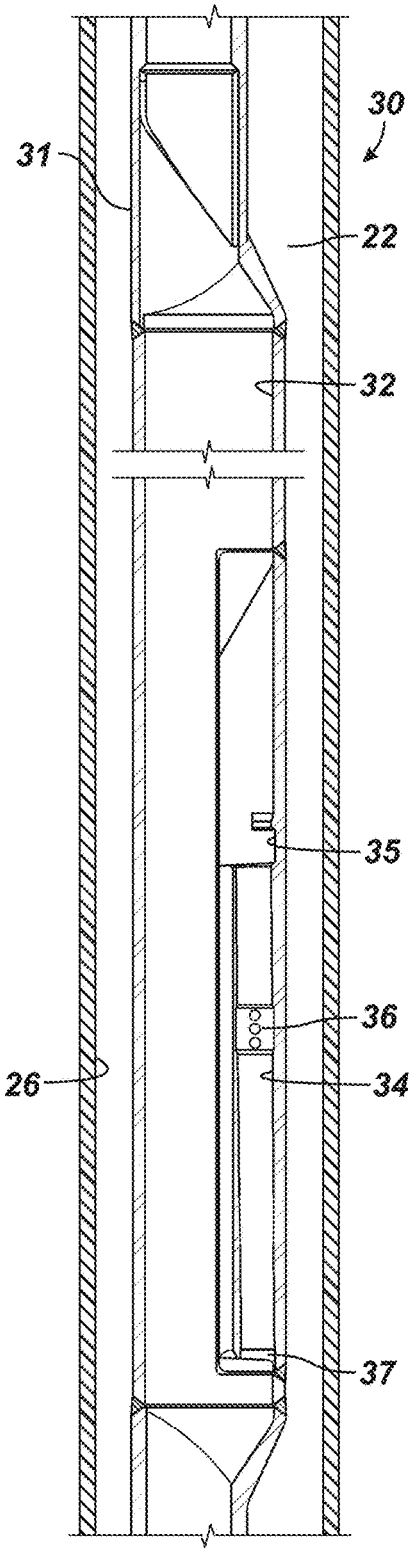
FIGS. 2A-2B illustrate a portion of a mandrel assembly having a wireline-retrievable gas lift valve for use in an artificial lift system according to the present disclosure.
Figure 2B:
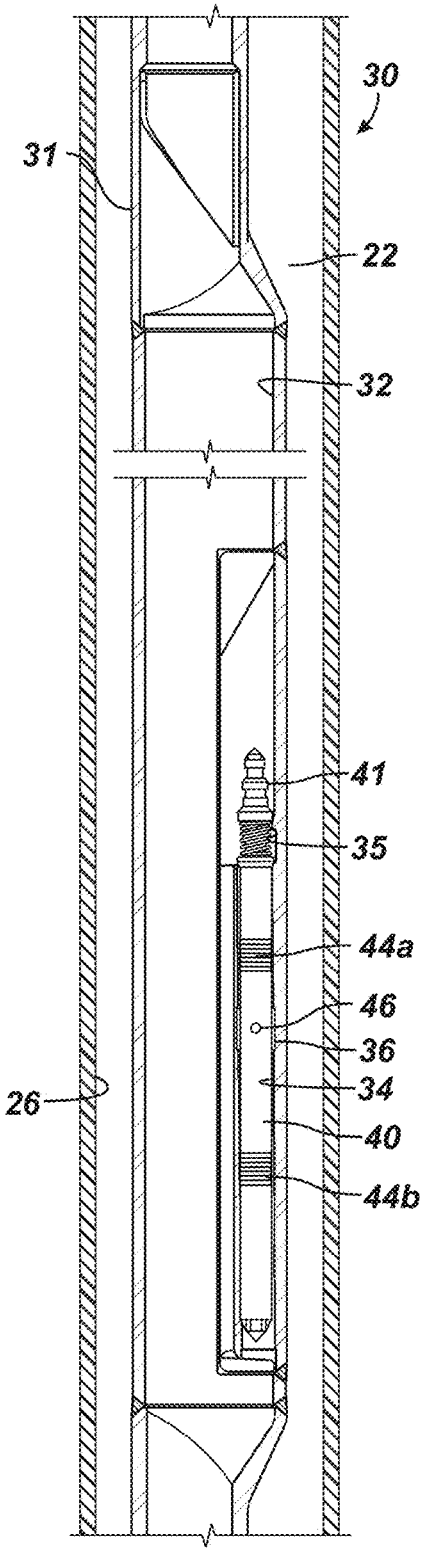

FIGS. 2A-2B show a portion of a mandrel assembly 30 for an artificial lift system 11 according to the present disclosure. The mandrel assembly 30 is installed on a tubing string of a borehole completion and is configured to control flow. In this example, the mandrel assembly 30 includes a mandrel or body 31 having a side pocket 34 configured to hold a gas lift valve 40, orifice valve, check valve, dummy valve, or the like. The mandrel assembly 30 is shown in FIG. 2A without the gas lift valve 40 installed and is shown in FIG. 2B with the gas lift valve 40 installed. With the gas lift valve 40 installed, the mandrel assembly 30 can be used to perform artificial lift (i.e., gas lift) in a borehole.

Figure 3:
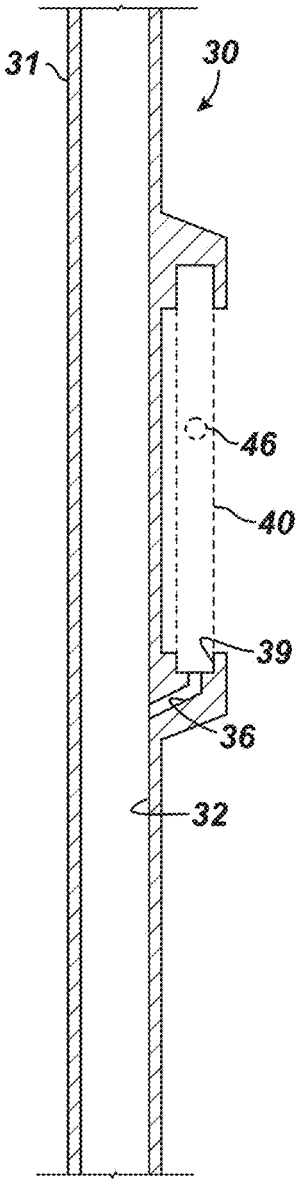
FIG. 3 illustrates a portion of a mandrel assembly having a tubing-retrievable gas lift valve for use in an artificial lift system according to the present disclosure.

As shown here in FIGS. 2A-2B, the gas lift valve 40 is wireline-retrievable. However, as shown in FIG. 3, the teachings of the present disclosure can apply to other types of gas lift valves, such as a tubing-retrievable gas lift valve 40 when used with an appropriate mandrel assembly 30 and tubing running procedures. As best represented in FIG. 2B, the gas lift valve 40 includes an internal one-way valve or check valve (not shown) to control fluid communication from the borehole annulus 22 via one or more borehole ports 36 to the internal throughbore 32 of the mandrel assembly 30 (and to the tubing string to which the mandrel assembly 30 is connected).

In FIGS. 2A-2B, the gas lift valve 40 can be run into the tubing sting by wireline and can be inserted into the side pocket 34 of the mandrel 31. A latch 41 of the gas lift valve 40 engages a profile 35 in the side pocket 34 to hold the gas lift valve 40 therein. Packing seals 44*a-b* on the gas lift valve 40 isolate fluid communication between the one or more borehole ports 36 on the mandrel assembly 30 and a valve port 46 on the gas lift valve 40.

In FIG. 3, the gas lift valve 40 is installed externally on a mandrel 31 of another mandrel assembly 30 for an artificial lift system of the present disclosure. The gas lift valve 40 and the mandrel assembly 30 are run in the borehole using the tubing string. The gas lift valve 40 typically installs in (affixes in) an external pocket 39 or another feature on the mandrel 31. As before, an internal one-way valve or check valve (not shown) of the gas lift valve 40 control fluid communication from the borehole annulus (22) to the internal throughbore 32 of the mandrel assembly 30 via the one or more borehole ports 36.

As described above and elsewhere herein, the gas lift valve 40 can be an unloading-type of gas lift valve used for a typical tubing flow application. In this instance, gas is injected down the borehole annulus 22 and can enter the tubing string through the mandrel assembly 30 and the gas lift valve 40 so the injected gas can then lift production fluid up the tubing string. As appropriate, other arrangements for gas lift valves can be used.

Figure 4:
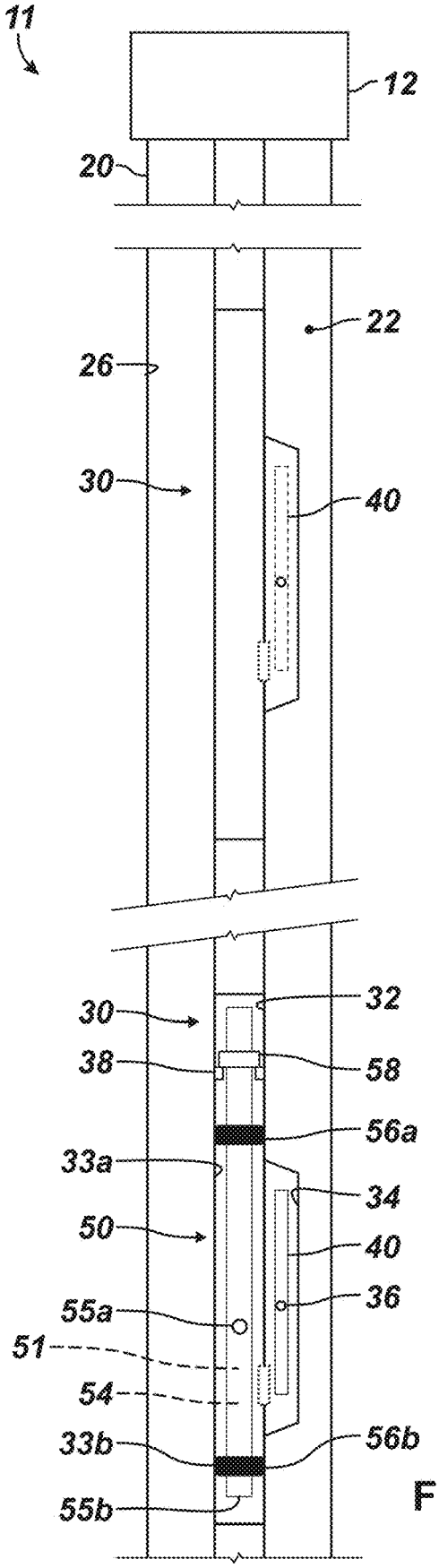
FIG. 4 illustrates an artificial lift system according to the present disclosure.

FIG. 4 illustrates an example of an artificial lift system 11 according to the present disclosure. The artificial lift system 11 has multiple gas lift valves 40 installed on a tubing string 20 disposed in casing 24 of a borehole. Each of the gas lift valves 40 is installed in a mandrel assembly 30 on the tubing string 20, and each of the gas lift valves 40 has a one-way valve or a check valve (not shown) to control fluid communication from the borehole annulus (22), through the gas lift valve 40 to the mandrel assembly 30, and into the tubing string 20.

In this example, each of the mandrel assemblies 30 includes a side pocket 34 in which the gas lift valve 40 is installed. The throughbore 32 of the mandrel assembly 30 also accommodates through-tubing equipment, tools, or pumps to pass through the mandrel assembly 30 and to position adjacent the gas lift valve 40 in the mandrel's side pocket 34.

To improve production, the artificial lift system 11 includes one or more mandrel assemblies 30, each of which is configured according to the present disclosure and is configured to receive a tool assembly 50 of the present disclosure. In particular, at least one tool assembly 50 can be installed in the tubing string 20 for use with at least one of the gas lift valves 40 in one of the configured mandrel assemblies 30. In the present example, one tool assembly 50, including an auxiliary tool 51 (e.g., jet pump valve), is installed in a mandrel assembly 30 having a gas lift valve 40. In other implementations, additional tool assemblies 50 can be installed in the tubing string 20 in other mandrel assemblies 30 having the gas lift valves 40. Also, instead of having a gas lift valve 40, one or more of the mandrel assemblies 30 that does not include a tool assembly 50 installed therein may instead have a dummy valve installed therein to close off fluid communication of the tubing string 20 with the borehole annulus 22.

The mandrel assembly 30 has uphole and downhole ends and defines a throughbore 32, extends between the uphole and downhole ends. The mandrel assembly 30 also defines one or more borehole ports 36 that communicates between the throughbore 32 and the borehole annulus 22.

As noted herein and discussed above with respect to FIGS. 2A-2B, the mandrel assembly 30 can define a side pocket 34 disposed adjacent the throughbore 32, and the side pocket 34 can be configured to hold the gas lift valve 40 therein. The side pocket 34 is disposed in communication with the throughbore 32 and the one or more borehole ports 36. (In a noted alternative and discussed above with respect to FIG. 3, the mandrel assembly 30 can define an external pocket 39 disposed adjacent the throughbore 32, and the external pocket 39 can be configured to hold the gas lift valve 40 therein. The external pocket 39 can be disposed in communication with the throughbore 32 via the one or more borehole ports 36.)

Either way, the gas lift valve 40 can control communication from the borehole annulus 22, through the one or more borehole ports 36, and into the throughbore 32 of the mandrel assembly 30. The uphole end of the mandrel assembly 30 is configured to couple to the tubing string 20, and the throughbore 32 at the uphole end defines a lock profile 38 and defines an uphole seal bore profile 33*a*. The downhole end of the mandrel assembly 30 is configured to couple to the tubing string 20, and the throughbore 32 at the down end defines a downhole seal bore profile 33*b*. As shown, the lock profile 38 is preferably defines at the uphole end of the mandrel assembly 30 beyond the uphole seal bore profile 33*a*. Of course, other arrangements can be used in which the lock profile 38 is defined elsewhere.

The tool assembly 50 is configured to retrievably deploy in the tubing string 20. The tool assembly 50 has a lock 58, an uphole seal element 56*a*, an auxiliary tool 51, and a downhole seal element 56*b*. The uphole seal element 56*a* is sealably engageable with the uphole seal bore profile 33*a*, and the downhole seal element 56*b* is sealably engageable with the downhole seal bore profile 33*b*. Meanwhile, the lock 58 is releasably engageable with the lock profile 68, which is preferably uphole the uphole seal element 56*a*. For its part, the auxiliary tool 51 has at least one annulus port 55*a* configured to communicate with an annular area of the throughbore 32 sealed by the uphole and downhole seals 33*a-b*.

During use, the mandrel assembly 30 is deployed on the tubing string 20 in the borehole 26. The mandrel assembly 30 is configured to hold the gas lift valve 40, which can be deployed when the tubing string 20 is run into the borehole 26 or can be installed later using slickline or wireline procedures. Initially, a gas lift operation is performed using the gas lift valve 40 installed in the mandrel assembly 30 while the tool assembly 50 is not installed. At some point during production, a decline of produced fluid from the gas lift operation can be identified.

When the efficiency of the gas lift operations declines, operators can then selectively install one or more of the tool assemblies 50 in the tubing string 20. As shown, the tool assembly 50 having the auxiliary tool 51 is removably installed in the throughbore 32 of one of the mandrel assembly 30 adjacent the respective gas lift valve 40. During installation, the lock 58 on the tool assembly 50 releasably engages with the lock profile 38 defined inside the throughbore 32. For example, the tool assembly 50 can be run on slickline or wireline in the tubing string 20, and running tools on the slickline or wireline can operate the lock 58 on the tool assembly 50 to engage in the lock profile 68.

As can also be seen, the tool assembly 50 having the auxiliary tool 51 installs in the throughbore 32 during installation by: (a) sealably engaging the downhole seal element 56*b* on the tool assembly 50 with the downhole seal bore profile 33*b* defined inside the throughbore 32 at a downhole end of the mandrel assembly 30, and (b) sealably engaging an uphole seal element 56*a* on the tool assembly 50 with the uphole seal bore profile 33*a* defined inside the throughbore 32 at the uphole end of the mandrel assembly 30. This seals at least one annulus port 55*a* of the tool assembly 50 with the gas lift valve 40.

As discussed herein, the auxiliary tool 51 can be a jet pump, a supersonic tool (SST), a venturi device, or the like. The lock 58 can include one or more dogs, keys, collets, or rings being selectively movable between locked and unlocked conditions to engage and disengage the lock profile 38 of the mandrel assembly 30. The uphole and downhole seals 33*a-b* can include elastomeric rings, chevron seals, cup seals, or the like, disposed about a circumference of the tool assembly 50.

With the tool assembly 50 installed in the mandrel assembly 30, a modified gas lift operation is performed using the gas lift valve 40 in the mandrel assembly 30, while also having the tool assembly 50 installed. For example, operators inject fluid (i.e., a power fluid, lift gas, or the like) into the borehole annulus 22 between the tubing string 20 and the casing 24 within the cased borehole. A valve system 12 at surface supplies the injected power fluid from the surface and allows production fluid lifted up the tubing string 20 to exit the gas lift system 10.

Figure 5:
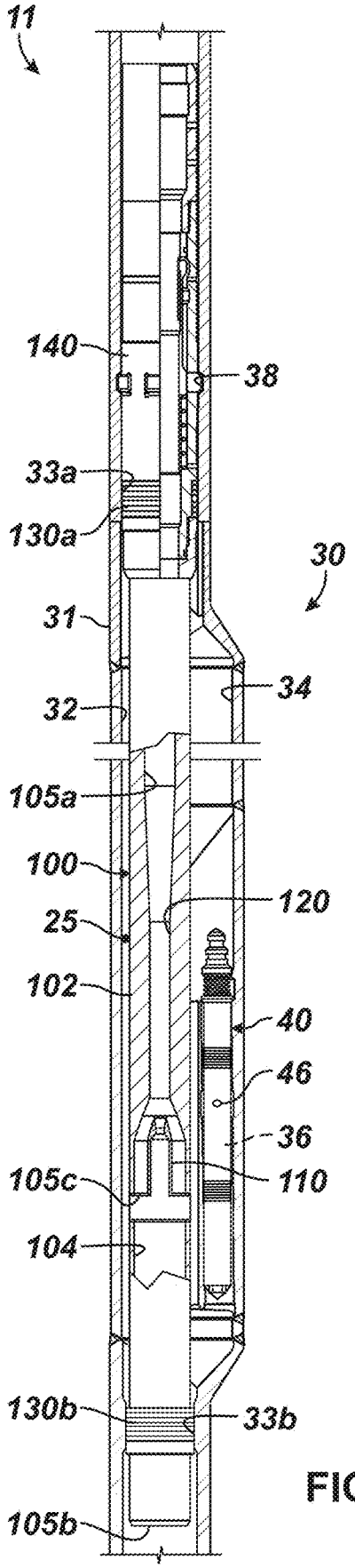
FIG. 5 illustrates a portion of the artificial system of the present disclosure having an example of a mandrel assembly and a tool assembly.

FIG. 5 illustrates an artificial lift system 11 of the present disclosure in more detail having one example of a mandrel assembly 30 and a tool assembly 100. As shown in the example of FIG. 5, the mandrel assembly 30 includes a mandrel or body 31, which defines a side pocket 34 in which a gas lift valve 40 or the like is installed. The upper end of the mandrel 31 includes an internal seal bore profile 33*a* and a lock profile 38 integrally formed therein. The lower end of the mandrel 31 includes a lower internal seal bore profile 33*b* integrally formed therein. The features of the seal bore profiles 33*a-b* and the lock profile 38 can be machined directly into the throughbore 32 of the mandrel 31.

Although the mandrel 31 shown here is of the side pocket type of mandrel, other types of mandrel assemblies and valves can be used. For example and as previously described with reference to FIG. 3, the mandrel assembly 30 can be configured to have a gas lift valve installed externally thereon, and the mandrel assembly and external gas lift valve can be run in the borehole during installation of the assembly. In any event, the side pocket 34 of the mandrel 31 in FIG. 5 allows for the gas lift valve 40 to be installed and removed using wireline/slickline procedures.

The tool assembly 100 includes an auxiliary tool 102, such as a jet pump, a supersonic tool (SST), a venturi device, or the like. The auxiliary tool 102 operates as a booster for existing gas lift wells to increase production and reduce the amount of gas lift required. Injected gas passes through a nozzle of the auxiliary tool 102, which creates a low-pressure zone at the throat. This low-pressure zone induces fluid flow from the reservoir of the auxiliary tool 102.

A lock mandrel 140 and an upper seal element 130*a* are disposed at an upper end of the auxiliary tool 102, and a lower seal element 130*b* is disposed at a lower end of the auxiliary tool 102. The tool assembly 100 can be an integrated tool including the features of the auxiliary tool 102, the seal elements 130*a-b*, and the lock mandrel 140. Alternatively, the tool assembly 100 can include a plurality of separate components having these features, which are threaded or connected to one another.

The tool assembly 100 can be installed via slickline or wireline into the mandrel assembly 30 so that the lower seal element 130*b* seals in the lower seal bore profile 33*b*, the upper seal element 130*a* seals in the upper seal bore profile 33*a*, and the lock mandrel 140 engages in the lock profile 38. For example, the tool assembly 50 can have a fishing neck on the lock mandrel 140 so the tool assembly 50 can be run and retrieved using slickline/wireline tools.

As a jet pump or a supersonic tool, the auxiliary tool 102 is installed in the mandrel 31 of the artificial lift system 11 to improve production. The auxiliary tool 102 includes a housing with a flow passage 104 passing therethrough. The flow passage 104 has an intake 105*b* located at a downhole end and has an output 105*a* located at an uphole end. The seal elements 130*a-b* on the tool assembly 100 sealingly engage the inner surface of the throughbore 32 of the mandrel 31 at the seal bore profiles 33*a-b* so production fluid flowing up the throughbore 32 is directed into the intake 105*b* of the auxiliary tool 102. As noted, the seal elements 130*a-b* can use O-rings, chevron seals, cup seal, or other sealing elements.

An annular area 25 is defined in the space between the mandrel 31 and the auxiliary tool 102 between the seal elements 130*a-b* sealed with the seal bore profiles 33*a-b*. The gas lift valve 40, which operates as a one-way valve, controls fluid communication from the borehole annulus (22) to this annular area 25. In particular, the gas lift valve 40 can allow fluid (e.g., inject gas) in the borehole annulus (22) to flow into the annular area 25 and can prevent flow in the reverse direction. In this respect, the fluid communicated from the borehole annulus (22), through the gas lift valve 40, and into the annular area 25 acts as a power fluid for the auxiliary tool 102.

Inside the auxiliary tool's housing, the flow passage 104 of the auxiliary tool 102 includes a nozzle section 110 and a venturi section 120. In particular, the flow passage 104 has an intake 105*b* in fluid communication with the tubing string 20 downhole of the downhole seal element 130*b*. The intake 105*b* communicates with a throat in the flow passage 104. The nozzle section 110 has a nozzle, which is disposed in the intake and has an inlet and an outlet. The inlet is disposed in fluid communication with the side ports 105*c* of the auxiliary tool assembly 100, and the outlet is disposed in fluid communication with the throat of the flow passage 104.

For its part, the venturi section 120 has a mixing tube and a diffuser. The mixing tube is disposed in fluid communication with the throat, and the diffuser is disposed in fluid communication with the mixing tube. The diffuser has an output 105*a* disposed in fluid communication with the tubing string 20 uphole of the uphole seal element 130*a*.

In operation, production fluid flows upward into the tubing string (20) and enters the auxiliary tool 102 via the intake 105*b*. Fluid flowing through the intake 105*b* of the flow passage 104 flows past the nozzle section 110 toward the venturi section 120. Meanwhile, power fluid (e.g., injected gas) supplied down the borehole annulus (22) passes through the gas lift valve 40 and enters the annular area 25. (Depending on the implementation, exemplary power fluids include gas, water, oil, hydrocarbon, and combinations thereof.) The power fluid (injected gas) communicated into the annular area 25 from the gas lift valve 40 enters the annulus ports or side ports 105*c* formed in the auxiliary tool 102.

Entering the side ports 105*c*, the power fluid (injected gas) communicates inside the nozzle section 110, which includes the nozzle having the outlet that communicate with the throat of the flow passage 104. The nozzle increases the velocity of the power fluid, which flows out the nozzle section 110 to the inwardly tapered throat, where the power fluid (jetted gas) encounters the production fluid. The high velocity power fluid and production fluid from the nozzle section 110 enters the venturi section 120, where the combined fluid encounters the mixing tube and diffuser. The outward taper of the diffuser of the venturi section 120 then increases the pressure of the mixed fluids flowing out of the venturi section 120 while decreasing the velocity of the mixed fluids as the lifted fluid travels toward the pump's output 105*a*. The lifted fluid flows up through the lock mandrel 140 and flows out of the output 105*a* of the auxiliary tool 102 to enter the tubing string (20) above the assembly.

In general, the mandrel assembly 30 disclosed herein can be an integral component having the features of the mandrel 31, seal bores 33*a-b*, and lock profile 38 integrally formed therein. Alternatively, the mandrel assembly 30 disclosed herein can be comprised of more than one separate component, which can have the respective features and can be threaded or connected together to make up the complete mandrel assembly 30. Likewise, the tool assembly 100 disclosed herein can be an integral component having the features of the auxiliary tool 102, seal elements 130*a-b*, and lock mandrel 140 integrally formed together. Alternatively, the tool assembly 100 disclosed herein can be comprised of more than one separate component, which can have the respective features and can be threaded or connected together to make up the complete tool assembly 100.

Figure 6A:
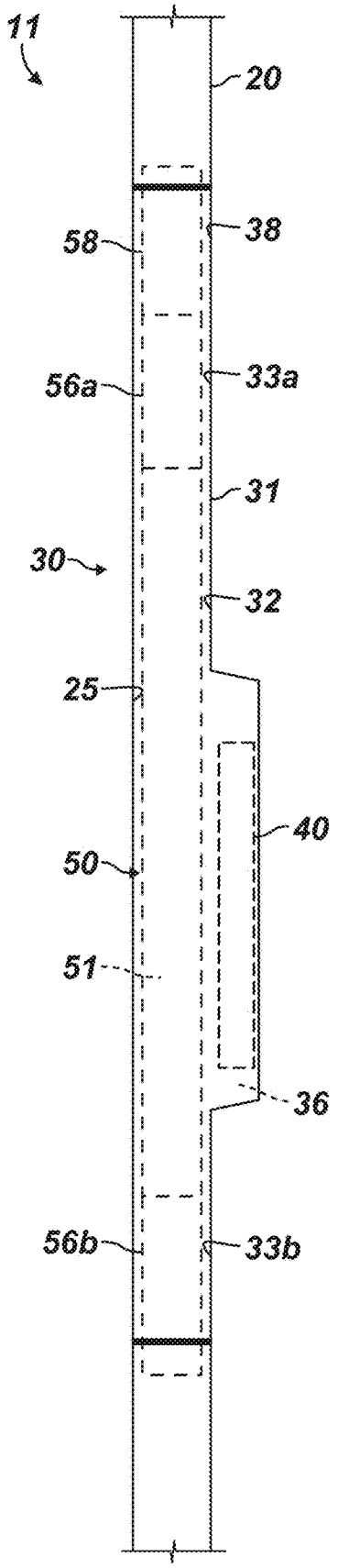
FIG. 6A schematically illustrates one configuration for an artificial system of the present disclosure.

For example, FIG. 6A shows one configuration of an artificial lift system 11 having a mandrel assembly 30 with a tool assembly 50 installed therein. As shown in FIG. 6A and discussed in previous examples, the mandrel assembly 30 can include a mandrel 31 having uphole and downhole ends and defining a throughbore 32 and one or more borehole ports 36. The mandrel 31 can define an internal side pocket or external pocket in which the gas lift valve 40 is installed so the gas lift valve 40 can control fluid communicated from the borehole annulus, through the borehole port 36, and into the annular area 25 around the tool assembly 50.

The uphole end of the mandrel 31 is configured to couple to the tubing string 20. The mandrel's uphole end defines an integrated lock profile 38 formed therein for engaging the tool's lock 58 and defines an integrated seal bore profile 33*a* formed therein for engaging the uphole seal element 56*a* of the tool assembly 50. Meanwhile, the downhole end of the mandrel 31 is configured to couple to the tubing string 20. The mandrel's downhole end defines another integrated seal bore profile 33*b* formed therein for engaging the downhole seal element 56*b* of the tool assembly 50.

Figure 6B:
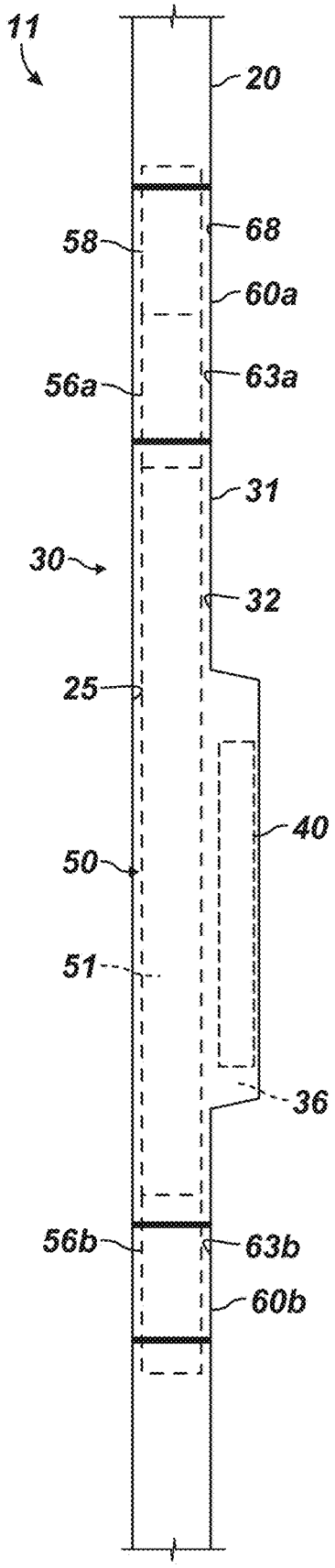
FIG. 6B schematically illustrates another configuration for an artificial system of the present disclosure.

In contrast to the integrated mandrel assembly 30 of FIG. 6A, an alternative arrangement of the mandrel assembly 30 in FIG. 6B includes a mandrel 31, an uphole component 60*a*, and a downhole component 60*b*. (Although shown with one uphole component 60*a* and one downhole component 60*b*, either of these can themselves be comprised of more than one component.)

The mandrel 31 has first and second ends and defines an intermediate portion or bore of the throughbore 32 of the mandrel assembly 30. The mandrel 31 defines one or more borehole ports 36 as before, and the mandrel 31 can include an internal side pocket or external pocket for the gas lift valve 40. The uphole component 60*a* is disposed at the uphole end of the mandrel assembly 30 and is configured to couple between the tubing string 20 and the first end of the mandrel 31. The uphole component 60*a*, which makes up an uphole portion or bore of the throughbore 32, defines a lock profile 68 for engaging the tool's lock 58 and defines an uphole seal bore profile 63*a* for engaging the uphole seal element 56*a* of the tool assembly 50.

Meanwhile, the downhole component 60*b* is disposed at the downhole end of the mandrel assembly 30 and is configured to couple between the tubing string 20 and the second end of the mandrel 31. The downhole component 60*b*, which makes up a downhole portion or bore of the throughbore 32, defines a downhole seal bore profile 63*b* for engaging the downhole seal element 56*b* of the tool assembly 50.

Here, the uphole and downhole components 60*a-b* can be tubular components or housings that are coupled to (e.g., threaded to) the ends of the mandrel 31. The uphole component 60*a* includes the internal seal bore profile 63*a* and the lock profile 68 integrally formed therein. The downhole component 60*b* includes the lower internal seal bore profile 63*b* integrally formed therein. In this way, the mandrel 31 can have conventional construction and features. As before, the tool assembly 50 includes an auxiliary tool 51, a lock 58, an uphole seal element 56*a*, and a downhole seal element 56*b*, which can be configured as noted as an integrated tool or two or more interconnected components.

Figure 6C:
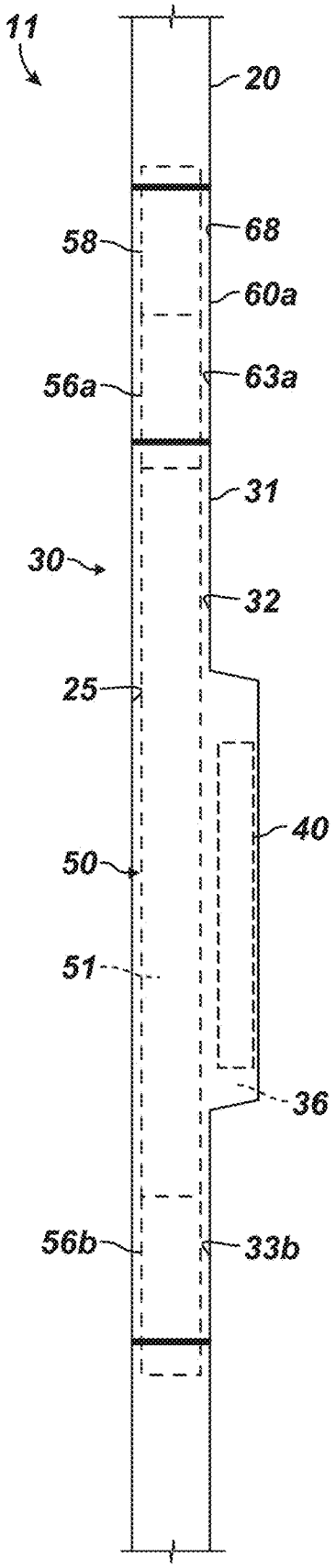
FIG. 6C schematically illustrates yet another configuration for an artificial system of the present disclosure.

Other variations are possible in which one or more of the lock profile, upper seal bore, and lower seal bore are integrated into the features of the mandrel 31 of the mandrel assembly 30. For example, FIG. 6C shows one such alternative arrangement. Here, an uphole component 60*a* is coupled to (e.g., threaded to) the upper end of the mandrel 31. The uphole component 60*a* includes an internal seal bore profile 63*a* and a lock profile 68 integrally formed therein. The lower end of the mandrel 31 includes a lower internal seal bore profile 33*b* integrally formed therein. These and other variations are possible.

Figure 7:
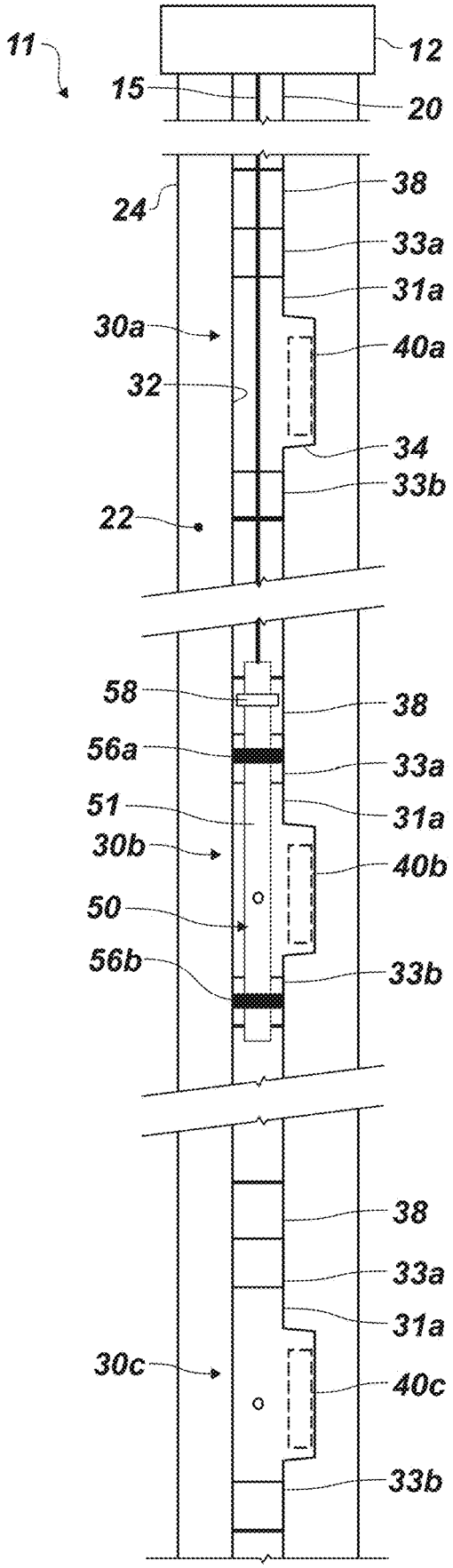
FIG. 7 illustrates another artificial lift system according to the present disclosure.

FIG. 7 illustrates another configuration of an artificial lift system 11 according to the present disclosure. The artificial lift system 11 has multiple mandrel assemblies 30*a-c* installed on a tubing string 20 disposed in casing 24 of a borehole. Each of the mandrel assemblies 30*a-c* includes a side pocket 34 in which a gas lift valve, orifice valve, check valve, dummy valve, or the like is installed. In this example, each of the mandrel assemblies 30*a-c* includes a gas lift valves 40*a-c* installed therein, and each of the gas lift valves 40*a-c* has a one-way valve or a check valve (not shown) to control fluid communication through the gas lift valve 40*a-c*. The throughbores 32 of the mandrel assemblies 30*a-c* are configured to accommodate through-tubing equipment, tools, or pumps to pass through the respective mandrel assembly 30*a-c* and position adjacent the respective gas lift valve 40*a-c* in the mandrel's side pocket 34.

To improve production, each of mandrel assemblies 30*a-c* is configured according to the present disclosure and is configured to receive a tool assembly 50 of the present disclosure. In particular, at least one tool assembly 50 can be selectively installed in the tubing string 20 for use with at least one of the gas lift valves 40*a-c* in one of the configured mandrel assemblies 30*a-c*.

In the present example, one tool assembly 50, including an auxiliary tool 51 (e.g., jet pump valve), is installed in a mandrel assembly 30*b* having a gas lift valve 40*b*. In other implementations, additional tool assemblies 50 can be installed in the tubing string 20 in other mandrel assemblies 30*a*, 30*b* having the gas lift valves 40*a*, 40*b*. Also, instead of having a gas lift valve, one or more of the mandrel assemblies 30*a*, 30*b* that does not include a tool assembly 50 installed therein may instead have a dummy valve installed therein to close off fluid communication of the mandrel assembly 30*a*, 30*c* with the borehole annulus 22.

Each of the mandrel assemblies 30*a-c* has uphole and downhole ends and defines a throughbore 32 and one or more borehole ports (not shown). The throughbore 32 extends between the uphole and downhole ends. As noted herein and discussed above, the mandrel assemblies 30*a-c* can define a side pocket 34 disposed adjacent the throughbore 32 and configured to hold the gas lift valve 40*a-c* therein. The side pocket 34 is disposed in communication with the throughbore 32 and the one or more borehole ports (not shown).

Either way, the gas lift valve 40*a-c* can control communication from the borehole annulus 22, through the one or more borehole ports (not shown), and into the throughbore 32 of the mandrel assembly 30*a-c*. The uphole end of each mandrel assembly 30*a-c* is configured to couple to the tubing string 20, and the throughbore 32 at the uphole end defines a lock profile 38 and an uphole seal bore profile 33*a*. The downhole end of each mandrel assembly 30*a-c* is configured to couple to the tubing string 20, and the throughbore 32 at the down end defines a downhole seal bore profile 33*b*.

As before, the tool assembly 50 is configured to retrievably deploy in the tubing string 20. The tool assembly 50 has an uphole lock 58, an uphole seal element 56*a*, an auxiliary tool 51, and a downhole seal element 56*b*. The uphole seal element 56*a* can sealably engage with the uphole seal bore profile 33*a*, and the downhole seal element 56*b* can sealably engage with the downhole seal bore profile 33*b*. The uphole lock 58 can releasably engage with the lock profile 68. The auxiliary tool 51 has at least one annulus port 55*a* configured to communicate with an annular area of the throughbore 32 sealed by the uphole and downhole seals 33*a-b*.

During use, the mandrel assemblies 30*a-c* are deployed on the tubing string 20 in the borehole. The mandrel assemblies 30*a-c* are configured to hold the gas lift valves 40*a-c*, which can be deployed when the tubing string 20 is run into the borehole or can be installed later using slickline or wireline procedures.

When the efficiency of the gas lift operations declines, operators can individually install one or more tool assemblies 50 in the tubing string 20 using a slickline or wireline 15 in a slickline or wireline operation or using some other installation technique. Running tools on the slickline or wireline 15 can operate the lock 58 on the tool assembly 50. In particular, one or more tool assemblies 50 having the auxiliary tool 51 can be removably and selectively installed in the throughbore 32 of any one or more the mandrel assemblies 30*a-c* adjacent the gas lift valve 40*a-c*.

As shown in the present example, one tool assembly 50 having the auxiliary tool 51 has been removably installed in the throughbore 32 of one of the mandrel assemblies 30*b* adjacent its gas lift valve 40*c*. Again, a lock 58 on the tool assembly 50 is releasably engaged with the lock profile 38 defined inside the throughbore 32 at an uphole end of the selected mandrel assembly 30*b*. Additionally, installation is achieved by: (a) sealably engaging a downhole seal element 56*b* on the tool assembly 50 with the downhole seal bore profile 33*b* defined inside the throughbore 32 at a downhole end of the mandrel assembly 30*c*, and (b) sealably engaging an uphole seal element 56*a* on the tool assembly 50 with the uphole seal bore profile 33*a* defined inside the throughbore 32 at an uphole end of the mandrel assembly 30*c*. This seals at least one annulus port of the tool assembly 50 with the gas lift valve 40*c*.

As discussed herein, the auxiliary tool 51 can be a jet pump, a supersonic tool, a venturi device, or the like. The uphole lock 58 can include one or more dogs, keys, collets, or rings being selectively movable between locked and unlocked conditions to engage and disengage the lock profile 38 of the mandrel assembly 30. The uphole and downhole seals 33*a-b* can include elastomeric rings, chevron seals, cup seals, or the like, disposed about a circumference of the tool assembly 50.

With the tool assembly 50 installed in the mandrel assembly 30*b*, operators can inject fluid (i.e., a power fluid) into the borehole annulus 22 between the tubing string 20 and the casing 24 within the cased borehole. A valve system 12 at surface can supply the injected power fluid from the surface and allows produced fluid to exit the gas lift system 10.

If the efficiency of another of the gas lift valves 40*a*, 40*c* declines, another the tool assembly 50 can be installed in a similar fashion. Should a tool assembly 50 need to be installed for the lower gas lift valve 40*c*, then any existing tool assemblies 50 uphole thereof may need to be retrieved to gain access to the lower mandrel assembly 30*c*. Those removed tool assemblies 50 would then need to be reinstalled once the lower tool assembly has been installed. Should a tool assembly 50 need to be installed for the upper gas lift valve 40*a*, these additional slickline runs may not be necessary.

In summary, the artificial lift system 11 disclosed herein does not require installing various tubing stops and pack-off accessories in multiple slickline operations to set and seal tools in place in a conventional assembly. The artificial lift system 11 enables through-tubing tools to be deployed and retrieved in the gas lift well while also providing original features of a gas lift mandrel for installation and removal of gas lift valves or other valves in the pocket of the mandrel.

The mandrel assembly 30 can have a side-pocket or other configuration. The mandrel assembly 30 has upper and lower seal bore profiles. In one arrangement, the seal bore profiles are formed directly in the mandrel or body 31. In an alternative arrangement, tubing components 60*a-b*, such as landing nipples or the like, install on the ends of the mandrel 31 and include the seal bore profiles. The upper end of the mandrel assembly 30 defines a lock profile 38 for engaging a lock 58 disposed on the tool assembly 50. This lock profile 38 can be formed directly in the mandrel 31 or can be part of a separate component connected to the mandrel 31.

The tool assembly 50 can be an integrally formed assembly or can be composed of separate components coupled end-to-end. Extensions or different sizes of the tool assembly 50 may be required to properly space/seat the tool assembly 50 into the seal bore profiles 33*a-b* and lock profile 38 in a given implementation.

Finally, the artificial systems 11 disclosed herein have been described in context of gas lift systems that use mandrels and gas lift valves disposed in a gas lift well. As will be appreciated, the teachings of the present disclosure can be used for other types of artificial lift systems and for other production systems in which a downhole mandrel is used for flow control and can benefit from the installation of an auxiliary tool, such as a jet pump, a supersonic tool (SST), a venturi device, or the like.

The foregoing description of preferred and other configurations is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

The invention claimed is:

1. A method of performing gas lift on a tubing string in a borehole, the method comprising:

deploying a mandrel assembly on the tubing string in the borehole, the mandrel assembly holding a gas lift valve installed in the mandrel assembly either before or after deployment of the mandrel assembly;

initially performing a gas lift operation using the gas lift valve in the mandrel assembly without having a tool assembly installed;

identifying a decline of produced fluid in the gas lift operation; and in response to the decline, removably installing the tool assembly in a throughbore of the mandrel assembly adjacent the gas lift valve by:

sealing at least one annulus port of the tool assembly with the gas lift valve; and releasably engaging a lock on the tool assembly with a lock profile defined inside the throughbore of the mandrel assembly; and performing a modified gas lift operation using the gas lift valve in the mandrel assembly having the tool assembly installed.

2. The method of claim 1, wherein sealing the at least one annulus port of the tool assembly with the gas lift valve comprises:

sealably engaging a downhole seal on the tool assembly with a downhole seal bore profile defined inside the throughbore toward a downhole end of the mandrel assembly; and sealably engaging an uphole seal on the tool assembly with an uphole seal bore profile defined inside the throughbore toward an uphole end of the mandrel assembly.

3. The method of claim 2, wherein the mandrel assembly comprises a mandrel body having the uphole end and the downhole end; and wherein deploying the mandrel assembly on the tubing string in the borehole comprises:

coupling the uphole end and the downhole end of the mandrel body to the tubing string, the mandrel body defining the throughbore and defining a borehole port, the throughbore extending between the uphole end and the downhole end, the mandrel body being configured to hold the gas lift valve disposed in communication with the borehole port, the throughbore defining: the lock profile, the uphole seal bore profile toward the uphole end, and the downhole seal bore profile toward the downhole end.

4. The method of claim 2, wherein the mandrel assembly comprises a mandrel, a first component, and a second component; and wherein deploying the mandrel assembly on the tubing string in the borehole comprises:

coupling the first component between a first end of the mandrel and the tubing string;

coupling the second component between a second end of the mandrel and the tubing string, wherein the mandrel defines an intermediate bore of the throughbore of the mandrel assembly, the mandrel defining a borehole port, the mandrel being configured to hold the gas lift valve disposed in communication with the borehole port;

wherein the first component defines an uphole bore of the throughbore in which the lock profile and the uphole seal bore profile are defined; and wherein the second component defines a downhole bore of the throughbore in which the downhole seal bore profile is defined.

5. The method of claim 2, wherein each of the uphole seal and the downhole seal comprises at least one of: an elastomeric ring, a chevron seal, and a cup seal disposed about the mandrel assembly.

6. The method of claim 1, wherein initially performing the gas lift operation comprises injecting gas into an annulus between the tubing string and the borehole, and controlling communication of the injected gas through the gas lift valve to the throughbore of the mandrel assembly; and wherein performing the modified gas lift operation comprises injecting gas into the annulus between the tubing string and the borehole, and controlling communication of the injected gas through the gas lift valve to the at least one annulus port of the tool assembly.

7. The method of claim 6, further comprising:

intaking production fluid into an intake of the tool assembly from the tubing string downhole of the tool assembly;

inletting the injected gas into the at least one annulus port of the tool assembly;

jetting the injected gas at the at least one annulus port from an outlet of a nozzle to a throat of the intake;

mixing the jetted gas and the production fluid in a mixing tube disposed in fluid communication with the throat of the intake; and diffusing the mixed gas and the production fluid from the mixing tube in a diffuser to an output in fluid communication with the tubing string uphole of the tool assembly.

8. The method of claim 1, wherein removably installing the tool assembly in the throughbore of the mandrel assembly adjacent the gas lift valve comprises running the tool assembly on at least one of a slickline and a wireline in the tubing string and operating the lock on the tool assembly.

9. The method of claim 1, wherein deploying the mandrel assembly on the tubing string in the borehole comprises deploying a plurality of the mandrel assembly on the tubing string; and wherein removably installing the tool assembly in the throughbore of the mandrel assembly comprises selectively installing the tool assembly in any one of the plurality of the mandrel assembly.

10. The method of claim 1, wherein removably installing the tool assembly in the throughbore of the mandrel assembly adjacent the gas lift valve comprises removably installing the tool assembly configured to retrievably deploy in the tubing string, the tool assembly having the lock, an uphole seal, an auxiliary tool, and a downhole seal; and wherein sealing the at least one annulus port of the tool assembly with the gas lift valve comprises:

sealably engaging the uphole seal with an uphole seal bore profile in the throughbore of the mandrel assembly; and sealably engaging the downhole seal with a downhole seal bore profile in the throughbore of the mandrel assembly, the auxiliary tool having the at least one annulus port configured to communicate with an annular area of the throughbore sealed by the uphole seal and the downhole seal.

11. The method of claim 10, wherein the auxiliary tool comprises at least one of a jet pump, a supersonic tool, and a venturi device.

12. The method of claim 10, wherein the auxiliary tool comprises:

an intake in fluid communication with the tubing string downhole of the downhole seal, the intake defining a throat;

a nozzle disposed in the intake, the nozzle having an inlet and an outlet, the inlet disposed in fluid communication with the at least one annulus port of the auxiliary tool, the outlet disposed in fluid communication with the throat of the intake;

a mixing tube disposed in fluid communication with the throat of the intake; and a diffuser disposed in fluid communication with the mixing tube, the diffuser having an output disposed in fluid communication with the tubing string uphole of the uphole seal.

13. The method of claim 1, wherein the mandrel assembly defines a side pocket communicating with the throughbore of the mandrel assembly, the side pocket being configured to hold the gas lift valve therein, the side pocket defining a borehole port in communication with the borehole, the gas lift valve being configured to control fluid communication between the borehole port and the throughbore; and wherein the method comprises installing the gas lift valve in the side pocket of the mandrel assembly either before or after deployment of the mandrel assembly on the tubing string in the borehole.

14. The method of claim 1, wherein the mandrel assembly defines an external pocket communicating with a borehole port of the mandrel assembly, the borehole port communicating with the throughbore, the external pocket being configured to hold the gas lift valve therein, the gas lift valve being configured to control fluid communication between the borehole and the borehole port; and wherein the method comprises installing the gas lift valve in the external pocket of the mandrel assembly before deployment of the mandrel assembly on the tubing string in the borehole.

15. The method of claim 1, wherein the mandrel assembly comprises a landing nipple having the lock profile; and wherein the tool assembly comprises a lock mandrel having the lock.

16. The method of claim 1, wherein the lock comprises at least one of: a dog, a key, a collet, and a ring being selectively movable between locked and unlocked conditions.

17. A method of performing gas lift on a tubing string in a borehole, the method comprising:

deploying mandrel assemblies on the tubing string in the borehole, each respective one of the mandrel assemblies holding a gas lift valve installed therein either before or after deployment of the respective mandrel assembly;

initially performing a gas lift operation using the gas lift valves in the mandrel assemblies;

identifying a decline of produced fluid in the gas lift operation; and in response to the decline, selecting one or more selected ones of the mandrel assemblies to each receive a respective tool assembly;

removably installing the respective tool assembly in a throughbore of each selected mandrel assembly adjacent the respective gas lift valve by:

sealing at least one annulus port of the respective tool assembly with the respective gas lift valve; and releasably engaging a lock on the respective tool assembly with a lock profile defined inside the throughbore of the selected mandrel assembly; and performing a modified gas lift operation using the gas lift valves in the mandrel assemblies.

18. The method of claim 17, wherein removably installing the respective tool assembly in the throughbore of each selected mandrel assembly adjacent the respective gas lift valve comprises:

running the respective tool assembly on at least one of a slickline and a wireline in the tubing string; and operating a lock mandrel for the lock on the respective tool assembly to engage a landing nipple for the lock profile for the selected mandrel assembly.

19. The method of claim 17, wherein sealing the at least one annulus port of the respective tool assembly with the gas lift valve comprises:

sealably engaging a downhole seal on the respective tool assembly with a downhole seal bore profile defined inside the throughbore toward a downhole end of the selected mandrel assembly; and sealably engaging an uphole seal on the respective tool assembly with an uphole seal bore profile defined inside the throughbore toward an uphole end of the selected mandrel assembly.

20. The method of claim 17, wherein initially performing the gas lift operation comprises injecting gas into an annulus between the tubing string and the borehole, and controlling communication of the injected gas through the gas lift valve to the throughbore of the mandrel assembly; and wherein performing the modified gas lift operation comprises injecting gas into the annulus between the tubing string and the borehole, and controlling communication of the injected gas through the gas lift valve to the at least one annulus port of the respective tool assembly.

21. The method of claim 20, wherein the respective tool assembly comprises at least one of a jet pump, a supersonic tool, and a venturi device.

* * * * *